US008177120B2

(12) United States Patent
Wickart

(10) Patent No.: US 8,177,120 B2
(45) Date of Patent: May 15, 2012

(54) CURRENCY DONATION MACHINE USING AIR CURRENT

(75) Inventor: Mark A. Wickart, Lisle, IL (US)

(73) Assignee: DuPage Children's Museum, Inc., Naperville, IL (US)

( * ) Notice: Subject to any disclaimer, the term of this patent is extended or adjusted under 35 U.S.C. 154(b) by 0 days.

(21) Appl. No.: 13/065,642

(22) Filed: Mar. 25, 2011

(65) Prior Publication Data

US 2011/0233269 A1 Sep. 29, 2011

Related U.S. Application Data

(60) Provisional application No. 61/341,111, filed on Mar. 26, 2010.

(51) Int. Cl.
*A45C 1/12* (2006.01)

(52) U.S. Cl. ..... 232/1 D; 232/43.3; 406/191; 446/176

(58) Field of Classification Search ..... 232/1 D, 232/4 R, 44, 43.3; 40/412, 422, 439, 406, 40/477; 446/199, 176, 220; 406/191–197, 406/34; 109/68
See application file for complete search history.

(56) References Cited

U.S. PATENT DOCUMENTS

| | | | | | |
|---|---|---|---|---|---|
| 96,187 | A * | 10/1869 | Beach | 406/117 |
| 3,888,433 | A * | 6/1975 | Fish | 406/184 |
| 4,915,547 | A * | 4/1990 | Cahill et al. | 406/87 |
| 5,299,889 | A * | 4/1994 | Langenbeck | 406/88 |
| 5,417,524 | A * | 5/1995 | Newton | 406/88 |
| 5,465,909 | A * | 11/1995 | Roth | 232/1 D |
| 6,474,912 | B1 * | 11/2002 | Meeks | 406/13 |
| 6,609,873 | B2 * | 8/2003 | Just et al. | 414/390 |
| 6,729,808 | B1 * | 5/2004 | Nelson | 406/11 |
| 6,920,835 | B1 * | 7/2005 | Johnson | 109/68 |
| 7,234,898 | B2 * | 6/2007 | Brown | 406/110 |
| 7,264,421 | B2 * | 9/2007 | Brown | 406/112 |
| 7,431,200 | B2 * | 10/2008 | Nordgren et al. | 232/44 |

* cited by examiner

*Primary Examiner* — William L. Miller
(74) *Attorney, Agent, or Firm* — Carmen Patti Law Group, LLC

(57) ABSTRACT

A device which collects donations of paper currency by allowing a person to insert paper currency and subsequently cause it to be floated through one or more tubes to a collection box by means of air flowing through the tubes is disclosed. A user of the device may use a diverter box to select one of several collection boxes to receive the donation. An audible or visual signal announces that a donation has been made.

18 Claims, 5 Drawing Sheets

CURRENCY DONATION MACHINE USING AIR CURRENT

CROSS-REFERENCE TO RELATED APPLICATIONS

This application claims the benefit of U.S. Provisional Application No. 61/341,111, filed Mar. 26, 2010.

BACKGROUND

The present invention is directed to a device which collects donations of paper currency by allowing a person to insert the currency and subsequently cause it to be floated through one or more tubes to a collection box by means of air flowing through the tubes.

This section is intended to introduce the reader to various aspects of art that may be related to aspects of the present invention which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In various types of public establishments, for example, museums and park facilities, it is common to feature a donation box that encourages patrons of the establishment to make donations for the benefit of the facility. Often, these devices are simply a receptacle with a slot for the insertion of cash or coins. It has been found that in order in increase the quantity of contributions, it is worthwhile to provide some entertainment to the potential donor in exchange for his or her donation. One known device is the "wishing well" type shown in U.S. Pat. Nos. 4,762,512 and 7,704,118 where a coin is sent down a ramp then travels in circles around a funnel shape before dropping into a receptacle at the bottom of the device. Another type is shown in U.S. Pat. No. 5,282,636 where a coin is dropped into a tank filled with water or mineral oil and the user manipulates platforms to try to catch the coin as it drops. A fundamental principle of these devices is that an opportunity to play or be entertained encourages a donor to contribute coins to a worthy cause.

With ever-increasing operating costs, there is a need among many public establishments to further increase donations. As inflationary pressures cause coins to become increasingly less valuable, there is a need to encourage potential donors to donate the larger denominations available in paper currency instead of coins.

SUMMARY

A system constructed in accordance with the principles herein features an apparatus that can conveniently and flexibly move paper currency or any type of lightweight material of the same approximate size and shape from one location to another. Further, the apparatus provides an entertaining way to encourage patrons of a museum or other establishment to donate money to support the establishment or any other charitable organization using paper currency instead of coins.

The invention in one embodiment encompasses an apparatus. The apparatus comprises a donation box with an opening for the insertion of paper currency or other objects of a similar size and weight. The apparatus further comprises a length of tubing connecting an input of the donation box to an airflow device which generates an air flow through the donation box and into a second length of tubing. A diverter box has an input connected to the end of the second length of tubing and two outputs connected to third and fourth lengths of tubing. The diverter box also has an air diverter flap for selecting one of the two outputs. The third and fourth lengths end in collection boxes that receive the inserted paper currency. The apparatus further comprises a switch for activating the airflow device.

Another embodiment encompasses a method. The method includes the steps of inserting paper currency or objects of a similar weight or size into a donation box and activating an airflow device to generate an air flow which blows the paper currency through a tube into a collection box. The method further comprises the steps of providing a diverter box in the tubing between the donation box and two collection boxes and using an air diverter flap in the diverter box to select one of the collection boxes to receive the paper currency.

A better understanding of the objects, advantages, features, properties and relationships of the subject invention will be obtained from the following detailed description and accompanying drawings which set forth illustrative embodiments which are indicative of the various ways in which the principles of the invention may be employed.

DETAILED DESCRIPTION

Figure 1:
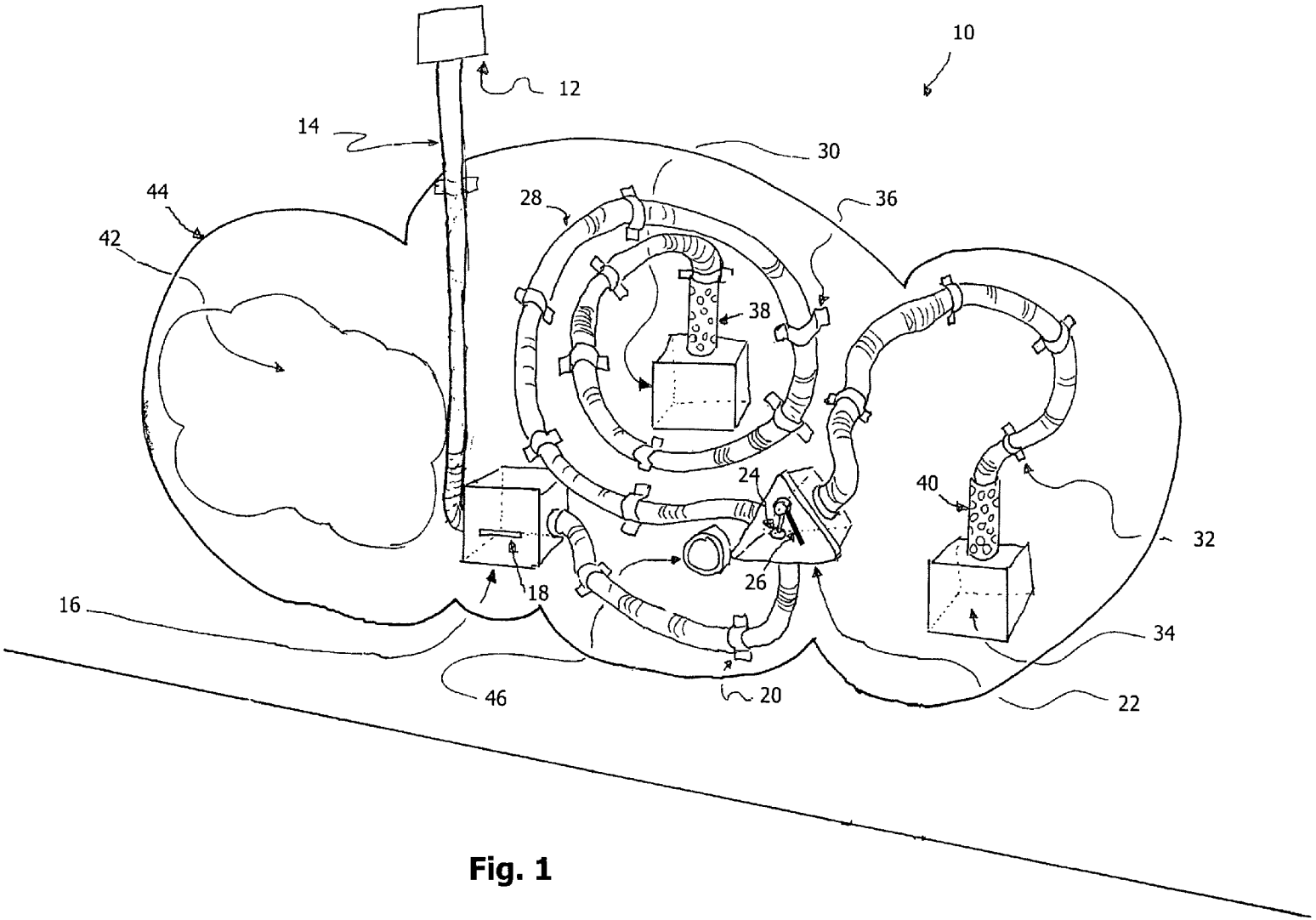
FIG. 1 illustrates an overall view of the currency donation machine constructed in accordance with the principles herein.

With reference to the figures, in which like numerals refer to like elements, the following generally describes an apparatus 10 of FIG. 1 for collecting paper currency donations. In a preferred embodiment, the apparatus is intended to collect paper currency donations but it may also be used in any situation where lightweight material of a similar size and shape needs to be moved from one location to another. Airflow device 12 provides an air flow through the entire apparatus. In a preferred embodiment, airflow device 12 is a squirrel cage fan but any suitable device for generating air flow may be used. As shown in FIG. 1, the entire apparatus is mounted to a wall using brackets as shown at 36 but it is also possible to provide a free-standing support structure for the apparatus. For example, a free-standing support structure could comprise a number of posts or a grid of support poles in a two- or three-dimensional arrangement. The inventive apparatus could also be wholly or partially suspended from the ceiling.

Airflow device 12 should be securely mounted at an appropriate distance from the rest of the apparatus. In FIG. 1 it is shown as being mounted above the rest of the apparatus but it may also be mounted on any side or below the apparatus, as well as behind the wall or under the floor. The exact location of airflow device depends on site-specific requirements. Factors influencing the decision of where to place the fan are safety, secure mounting location, noise of the device, speed of air flow generated by the device and length of tubing. The location of the airflow device can be adjusted to maximize or minimize all of these factors as needed.

Air flow generated by airflow device 12 travels through tubing section 14 to donation box 16. Tubing section 14 may be made of flexible or rigid tubing or a combination of both, depending on cost, availability and site-specific constraints. Tubing section 20 is connected to a side of donation box 16 directly opposite tubing section 14. Donation box 16 includes a slot 18 for a patron to insert paper currency. Slot 18 is shown as a narrow rectangle but any preferred shape could be used. After inserting the paper currency into donation box 16, the patron moves to diverter box 22 and uses handle 24 to set air diverter flap 26 in either a right or left position, then starts airflow device 12 using button 46, which should be located in close proximity to diverter box 22. When air diverter flap 26 is swung to the right, tube 32 is blocked causing the inserted paper currency to flow through tube 20 into the diverter box, through tube 28 and into collection box 30. When air diverter flap 26 is swung to the left, tube 28 is blocked causing the inserted paper currency to flow through tube 20 into the diverter box, through tube 32 and into collection box 34. It would also be possible to let airflow device 12 run continuously in which case the patron would select a position of air diverter flap 26 before inserting paper currency into slot 18. In an embodiment, button 46, in addition to activating airflow device 12, lights up and, when activated, causes an audible indication that a donation has been made, for example a bell, whistle or siren.

Tubing sections 20, 28 and 32 may be made from transparent, flexible plastic with an internal wire coil. A transparent material is most advantageous for the purposes of the invention so that patrons can see the movement of their donated currency through the apparatus but the tubing could also be opaque. The sections of tubing may be curved or straight. As shown in FIG. 1, tubing section 28 is in a spiral shape while sections 20 and 32 are more of a freeform shape. The specific arrangement of the tubes and boxes 16, 22, 30 and 34 is flexible and depends on site-specific constraints. It is important that paper currency moving through the tubes can move freely and not get caught anywhere. A certain amount of experimentation is required during installation to determine the minimum curvature of the tubes that will provide free flowing paper currency. Tubing sections can be connected to each other and to all other components in a variety of ways that would be well known to one of ordinary skill in the art, including PVC connectors, brackets or collars and thumb screws. Each tubing section may also be installed in multiple pieces, connected so as to provide a continuous air flow from one component to the next.

Figure 3:
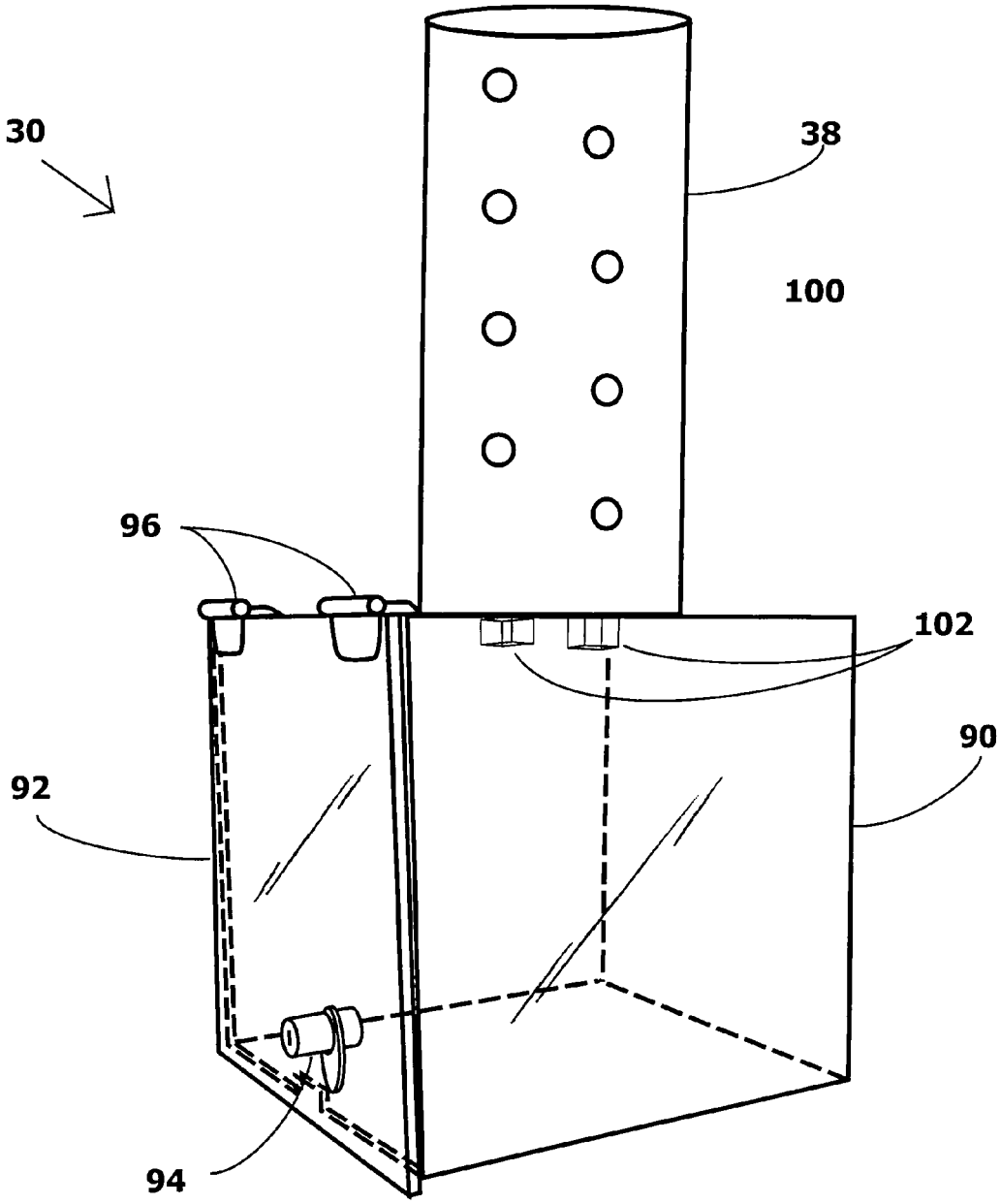
FIG. 3 illustrates a detailed view of one of the collection boxes of FIG. 1.

The last 1.5 to 2 feet of tubing sections 28 and 32 is made with rigid material that is vented with holes as shown at 38 and 40. This rigid material may be a PVC pipe but other materials with equivalent characteristics may be used. As the donated currency moves into tubing section 38 or 40, the air flow generated by airflow device 12 is vented through holes in the tubing sections. This allows the donated currency to drop down into collection boxes 30 and 34 with the aid of gravity. In an embodiment, optical sensors may be provided in tubing sections 38 and 40 or at the input of collection boxes 30 and 34 as shown in FIG. 3 so as to detect when a piece of paper currency passes and trigger a visual or audible indication that a donation has been made.

Donation box 16 and collections boxes 30 and 34 are suitably made of clear or transparent acrylic glass, available commercially under a wide variety of trade names, so that patrons may see the movement of the donated currency. Boxes 30 and 34 are provided with a hinged cover so that donated currency may be removed, as explained in more detail in accordance with FIG. 3. Diverter box 22 may have a clear or transparent front cover with a fabricated aluminum back and sides as explained in more detail with regard to FIG. 2.

In an embodiment, apparatus 10 is mounted to a wall using brackets 36 and other suitable attachment devices for the various components. Decorations may be applied to the wall and various components of apparatus 10 to support the theme of the installation as shown by the cloud representations at 42 and 44. Cloud shape 42 also provides a location for suitable signage. Other themes may be used as desired. Various components of apparatus 10 may also be colored so as to assist a patron to select which collection box would receive the donated currency. For example, tube 38 and the brackets attaching tube 28 to the wall may be one color, while tube 40 and the brackets attaching tube 32 to the wall may be another color.

In an embodiment, apparatus 10 may also include additional diverter boxes and collection boxes. For example, the input of an additional diverter box could be connected to one of the outputs of diverter box 22. The outputs of the additional diverter box could then be connected to two collection boxes via additional tubing sections, providing the patron with a selection of three collection boxes. The number of diverter and collection boxes is limited only by the speed of airflow device 12 and site-specific constraints such as available space.

Figure 2B:
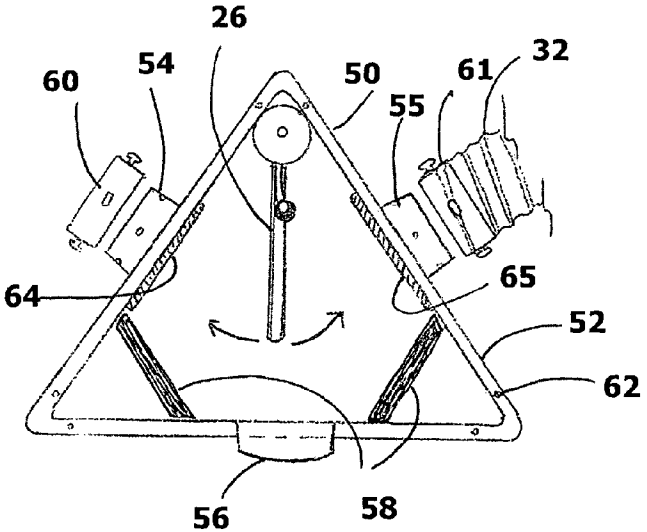
FIGS. 2A, 2B and 2C illustrate a detailed view of the diverter box of FIG. 1.
Figure 2A:
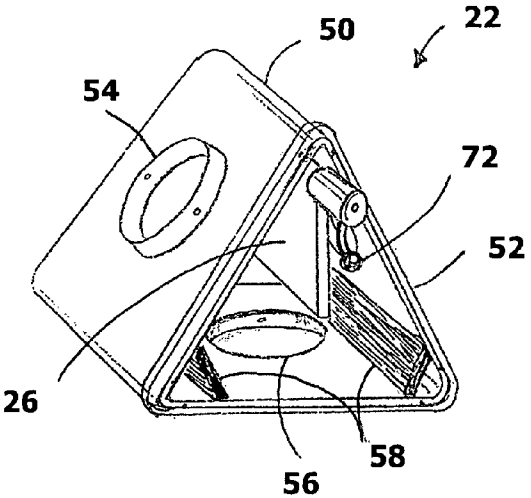
Figure 2C:
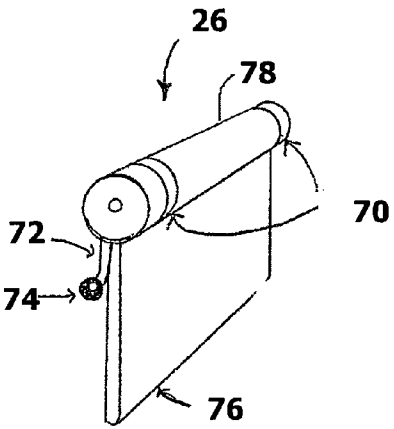

FIGS. 2A, 2B and 2C show more detailed views of diverter box 22. In a preferred embodiment, diverter box 22 is triangular but any suitable shape that provides good air flow and suitable mounting surfaces for the tubing sections could be used. In FIG. 2A, side panels 50 are made from fabricated aluminum but any sturdy material could be used, for example, wood or steel. A back triangular surface of diverter box 22 is also made of aluminum. Front cover 52 is suitably made from clear or transparent acrylic glass. Flanges 54 and 56 in side panels 50 are used to attach tubing to the box. There is an additional opening in the third side of the box, shown in more detail in FIG. 2B. Air diverter flap 26 is made of rigid, machinable shatter-resistant plastic and is suspended from a rod that extends across the top of box 22 through the front cover and back surface of the box. Air diverter flap 26 has a handle 72 which a patron uses to move the air diverter flap into a desired position. Deflectors 58 in the bottom right and left corners of diverter box 22 are used to improve airflow in the diverter box and prevent paper currency from becoming trapped in one of the corners. They are preferably made of plastic but any suitable material may be used.

FIG. 2B shows additional details of diverter box 22. Flanges 54, 55 and 56 are suitably made of aluminum and welded to side panels 50. In an embodiment, couplers 60 and 61 are used to attach tubing sections to diverter box 22 using thumbscrews. A similar coupler, not shown, is used to attach a tube to flange 56. One of ordinary skill in the art would be able to devise a number of ways to attach tubing sections to the flanges for instance, by using clamps and PVC couplers. Front cover 52 is attached to side panels 50 using screws and holes 62 disposed around the front edge of side panels 50. This allows easy access and maintenance of diverter box 22 and air diverter flap 26. Gaskets 64 and 65 are made of a soft plastic, for example, neoprene, and are glued to the inside of side panels 50. They provide a buffer and better air seal between air diverter flap 26 and side panels 50.

Air diverter flap 26 is shown in more detail in FIG. 2C. Flat portion 76 is attached to rod 78 and extends downward. Rod 78 extends through the front and back covers of diverter box 22. Bearings 70 in the plane of the front and back covers provide for rotation of air diverter flap 26 so that openings 54 and 55 in diverter box 22 may be covered as desired by the patron. Rod 78 extends outward through the front cover 52. A curved handle 72 ending in a plastic ball 74 is attached to the extending portion of rod 78. In a preferred embodiment, handle 72 and ball 74 allow patrons, especially young children, to successfully grasp and move the air diverter flap but any equivalent handle shape may be used. Handle 72 is used by a patron to move air diverter flap 26 into a desired position. In a preferred embodiment, rod 78 is approximately 0.75 inches in diameter with 0.5 inch diameter projections extending through bearings 70.

Collection box 30 is shown in more detail in FIG. 3. The following description also applies to collection box 34. Collection box 30 includes four side panels and a back panel, generally shown at 90. Collection box 30 also includes a front cover 92 which is connected to the rest of the box by hinges 96. A lock 94 is provided to protect the contents of the box and allow controlled removal of donated currency. Although collection box 30 has been shown with a hinged cover, other embodiments, for example a cover that slides open, would be well known to one of ordinary skill in the art. It would also be known to substitute other mechanisms for locking the box. In a preferred embodiment, collection boxes 30 and 34 are made with transparent acrylic glass but one of ordinary skill in the art would be able to make them our of any suitable material, including wood or metal.

Tubing section 38 extends upward from collection box 100. Tubing section 38 can be made of PVC or any rigid material that can be connected to tubing section 28 shown in FIG. 1. In a preferred embodiment, venting holes 100 are drilled in an equidistant pattern along the length of the pipe as shown in FIG. 3. Venting holes 100 are approximately 0.5 inches in diameter and are also continue around the back portion of tubing section 38 not shown in the figure. Venting holes 100 are used to cut down the air pressure flowing through apparatus 10 and allow the paper currency to drop down into collection box 30. Although the apparatus is shown with circular holes to vent the air flow, it would be understood by one of ordinary skill in the art that any shape or configuration could be used as long as the air flow was reduced adequately.

In an embodiment, collection box 30 may also include sensors 102 which detect when a piece of paper currency passes and trigger a visual or audible indication that a donation has been made.

Figure 4A:
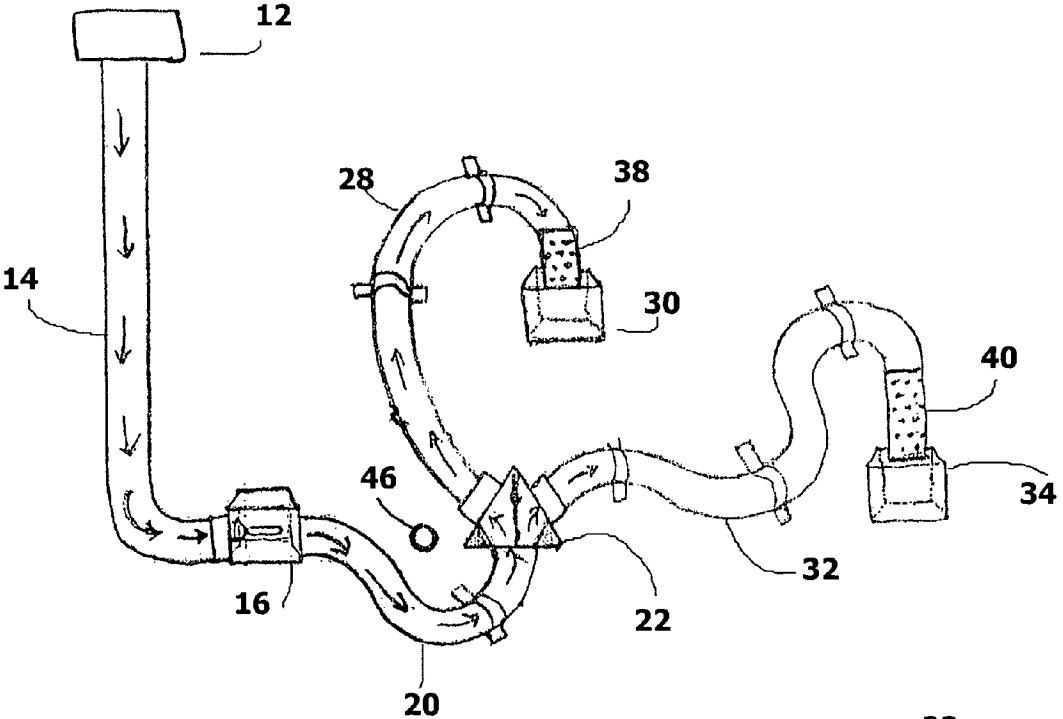
FIGS. 4A, 4B and 4C illustrate the air flow through the apparatus of FIG. 1
Figure 4B:
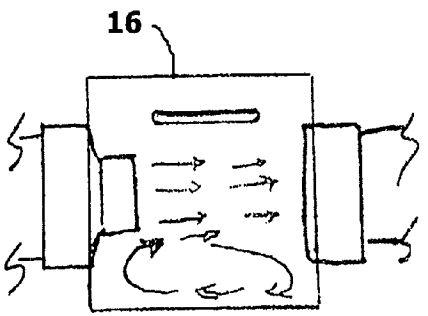
Figure 4C:
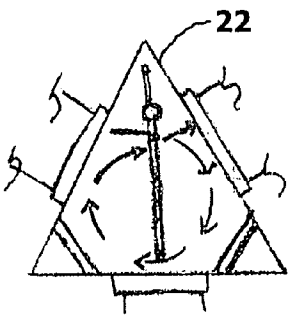

FIG. 4A shows the air flow through apparatus 10 when in operation. When a patron has inserted some paper currency into donation box 16, the air diverter flap is set in diverter box 22 and airflow device 12 is activated using button 46. In a preferred embodiment, button 46 lights up and, upon activation of the button, there is an audible indication that the button has been pressed, for example a bell, whistle or siren. After activation, airflow device 12 operates for a suitable amount of time required to move the paper currency to a collection box, approximately 15 seconds, then shuts off. The diameter of tubing 14 is reduced as it enters donation box 16 as shown in FIG. 4B so as to provide an appropriate pattern of air movement in the box and keep currency from becoming lodged in corners of the box. Air flow continues through tube 20 to diverter box 22. Diverter box 22 is triangular shaped with deflectors in the bottom two corners as explained in further detail with regard to FIG. 2A. This provides a circular air flow as shown in FIG. 4C which keeps the currency moving freely through the diverter box 22 and into either tube 28 or 32, as chosen by the patron. Finally, air flow is vented through holes in tubing 38 or 40 as explained above with regard to FIG. 3.

Figure 5:
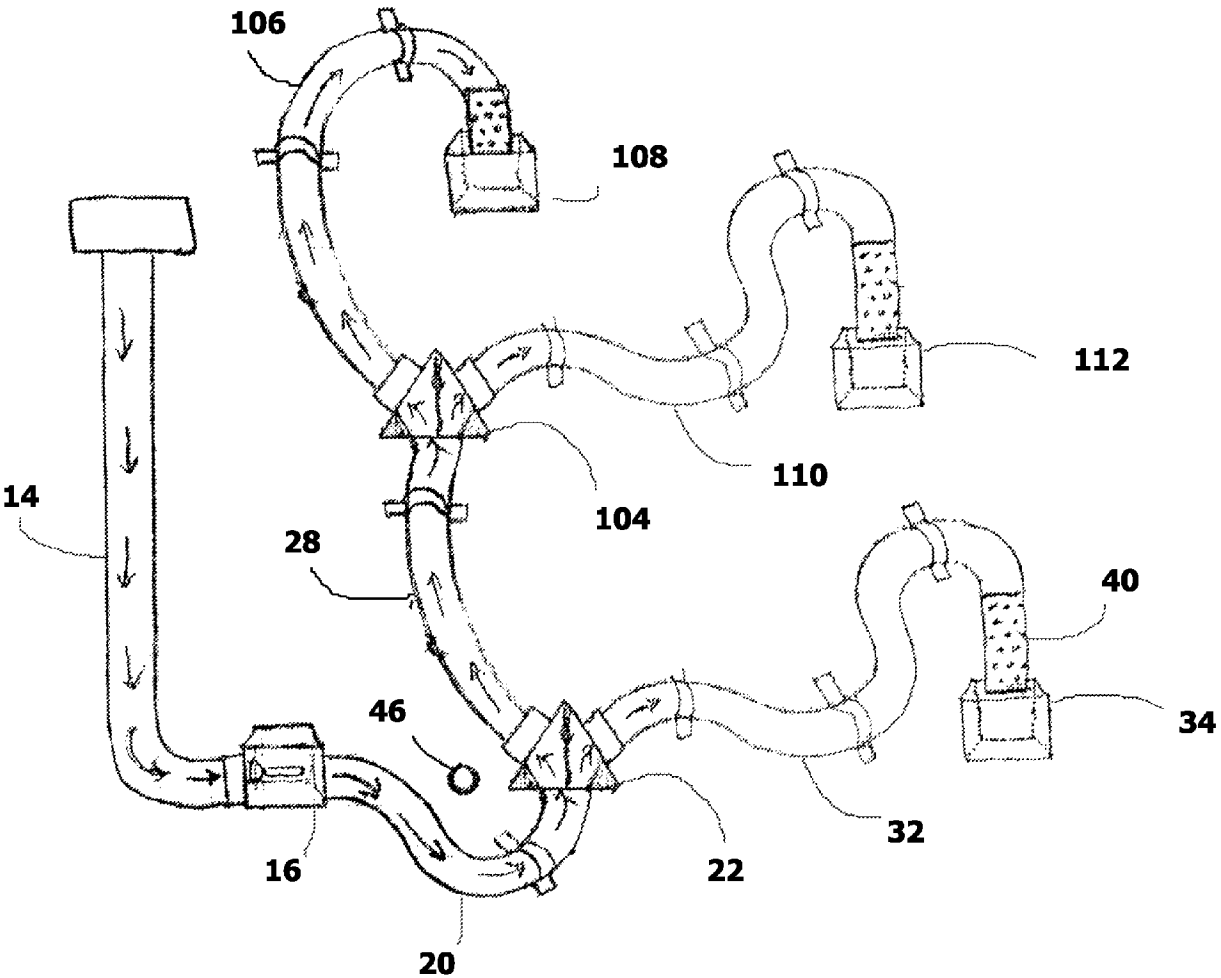
FIG. 5 illustrates an expanded version of the embodiment shown in FIG. 4A.

FIG. 5 shows an alternative embodiment including a second diverter box 104. Air flow may be directed using an air diverter flap in diverter box 104 into tubing 106 and collection box 108, or into tubing 110 and collection box 112. One of ordinary skill in the art would understand how any number of diverter boxes and collections boxes could be combined to arrive at a desired configuration.

From the foregoing description it will be appreciated that the subject invention has the advantages of, among other things, providing: an entertaining way to encourage patrons of an establishment like a museum to donate paper currency; a way to flexibly and conveniently move any type of lightweight material, for example, pieces of paper or envelopes, from one place to another. Furthermore, it will be appreciated by those skilled in the art that, while specific embodiments of the invention have been described in detail, various modifications and alternatives to those details could be developed in light of the overall teachings of this disclosure. Accordingly, the particular arrangements disclosed are meant to be illustrative only and not limiting as to the scope of the invention which is to be given the full breadth of the appended claims and any equivalents thereof.

The invention claimed is:

1. An apparatus for collecting one or more pieces of paper comprising:

a length of tubing;

an airflow device for generating air flow connected to one end of the tubing;

an input device for inserting the one or more pieces of paper into the tubing, the input device connected to the tubing proximate the one end; and a container connected to the other end of the tubing opposite the airflow device for receiving the one or more pieces of paper;

a diverter box connected to the tubing between the input device and the container, the diverter box diverting some of the air flow into a second length of tubing.

2. The apparatus of claim 1 further comprising:

a second container connected to an end of the second length of tubing for receiving paper currency.

3. The apparatus of claim 2 wherein an input to the first and second containers is in the top surface of the containers, and the portion of tubing immediately adjacent to the input to the first and second containers is vented so as to provide an outlet for the airflow generated by the airflow device.

4. The apparatus of claim 1 wherein the pieces of paper are paper currency, the input device is a slot in a donation box and the container is a collection box.

5. An apparatus for collecting donations of paper currency comprising:

a donation box with an opening for inserting the paper currency;

a first length of tubing connected at one end thereof to an input of the donation box;

an airflow device connected to the other end of the first length of tubing for generating airflow through the apparatus;

a second length of tubing connected at one end thereof to an output of the donation box;

a diverter box with an input connected to the other end of the second length of tubing;

a third length of tubing connected at one end thereof to a first output of the diverter box;

a first collection box with an input connected to the other end of the third length of tubing;

a fourth length of tubing connected at one end thereof to a second output of the diverter box;

a second collection box with an input connected to the other end of the fourth length of tubing;

an air diverter flap in the diverter box for directing airflow from the input of the diverter box to the first or second output of the diverter box.

6. The apparatus for collecting donations of paper currency of claim 5 further comprising:

a switch for activating the airflow device.

7. The apparatus for collecting donations of paper currency of claim 5 wherein the tubing is transparent, the diameter of the tubing is at least 3 inches, and the tubing is flexible such that portions of the tubing may be curved.

8. The apparatus for collecting donations of paper currency of claim 5 wherein the airflow device is a squirrel cage fan and is located above, below or on any side of the donation box.

9. The apparatus for collecting donations of paper currency of claim 5 wherein the airflow device, lengths of tubing, donation box, diverter box and collection boxes are attached to a wall.

10. The apparatus for collecting donations of paper currency of claim 5 wherein the airflow device, lengths of tubing, donation box, diverter box and collection boxes are supported by a free-standing structure.

11. The apparatus for collecting donations of paper currency of claim 5 wherein the input to the first and second collection boxes is in the top surface of the collection boxes, and the portion of tubing immediately adjacent to the input is vented so as to provide an outlet for the airflow generated by the airflow device.

12. The apparatus for collecting donations of paper currency of claim 5 wherein the donation box and the first and second collection boxes are made of transparent acrylic glass.

13. The apparatus for collecting donations of paper currency of claim 5 wherein the diverter box has a triangular cross-section, the sides of the diverter box are made of cast aluminum and the front of the diverter box has a cover made of transparent acrylic glass.

14. The apparatus for collecting donations of paper currency of claim 13 wherein the air diverter flap is held in the top corner of the triangular diverter box using bearings such that the air diverter flap may swing freely from side-to-side.

15. The apparatus for collecting donations of paper currency of claim 5 further comprising:

optical sensors at the inputs of the first and second collection boxes for detecting the passage of the paper currency and triggering a visual or audible indication that a donation has been made.

16. A method of collecting donations of paper currency comprising the steps of:

inserting the paper currency into a donation box, starting an airflow device to blow the paper currency from the donation box into a first collection box via a tube;

setting an air diverter flap in a first diverter box connected to the tube between the donation box and the collection box to direct the paper currency into the first collection box or to direct the paper currency into a second collection box via a second tube connected to and between the diverter box and the second collection box.

17. The method for collecting donations of paper currency of claim 16 wherein said step of starting an airflow device further comprises:

pushing a button that activates the airflow device and activates a device for giving visual or audible indications that a donation has been made.

18. The method for collecting donations of paper currency of claim 16 further comprising the step of:

setting a second air diverter flap in a second diverter box connected between the first diverter box and third and fourth collection boxes.

* * * * *